US008186062B2

(12) United States Patent
Fischer et al.

(10) Patent No.: US 8,186,062 B2
(45) Date of Patent: May 29, 2012

(54) SAFETY RAZOR WITH FILAMENT GUARD

(75) Inventors: Stephan Fischer, Gevelsberg (DE); Jochen Thoene, Wuppertal (DE)

(73) Assignee: Eveready Battery Company, Inc., St. Louis, MO (US)

( * ) Notice: Subject to any disclaimer, the term of this patent is extended or adjusted under 35 U.S.C. 154(b) by 608 days.

(21) Appl. No.: 12/049,431

(22) Filed: Mar. 17, 2008

(65) Prior Publication Data

US 2008/0229583 A1 Sep. 25, 2008

Related U.S. Application Data

(60) Provisional application No. 60/918,744, filed on Mar. 19, 2007.

(51) Int. Cl.
*B26B 21/06* (2006.01)

(52) U.S. Cl. ..... 30/34.2; 30/81; 30/50

(58) Field of Classification Search ..... 30/34.2, 30/81, 82, 50–55, 59–60.5
See application file for complete search history.

(56) References Cited

U.S. PATENT DOCUMENTS 5,191,712 A 3/1993 Crook et al.
5,416,973 A * 5/1995 Brown et al. ..... 30/34.2
5,546,660 A * 8/1996 Burout et al. ..... 30/50
5,689,883 A * 11/1997 Ortiz et al. ..... 30/34.2
5,711,076 A * 1/1998 Yin et al. ..... 30/41
5,794,343 A * 8/1998 Lee et al. ..... 30/50
5,953,819 A 9/1999 Simms et al.
7,043,840 B2 5/2006 Walker, Jr. et al.
2008/0115366 A1* 5/2008 Follo et al. ..... 30/50
2008/0209743 A1* 9/2008 Quintiliani et al. ..... 30/526

FOREIGN PATENT DOCUMENTS

WO WO 96/01171 1/1996

OTHER PUBLICATIONS

International Search Report for PCT/2008/057391, dated Jul. 4, 2008.

* cited by examiner

*Primary Examiner* — Boyer D Ashley
*Assistant Examiner* — Omar Flores Sanchez
(74) *Attorney, Agent, or Firm* — Energizer Personal Care, LLC

(57) ABSTRACT

A razor cartridge is provided with a skin engaging structure at the cap and/or guard surface of the razor cartridge. The skin engaging structure has an array of closely spaced elongated protrusions integrally formed with a substrate. In use, the protrusions produce a pleasant tactile sensation tending to reduce shaving discomfort. The protrusions are formed by closely packed molded flexible filaments that can be less than 0.25 mm wide and have spacing between adjacent protrusions less than 0.2 mm. The protrusions can have a density greater than 5 protrusions per $mm^2$. The skin engaging structure can be molded from e.g. an olefin polymer. The substrate can be integrally formed with a housing of the razor cartridge.

10 Claims, 6 Drawing Sheets

SAFETY RAZOR WITH FILAMENT GUARD

CROSS REFERENCE TO RELATED APPLICATIONS

This application claims the benefit of U.S. Provisional Patent Application Ser. No. 60/918,744, filed Mar. 19, 2007.

BACKGROUND OF THE INVENTION

Technical Field

This invention relates generally to shaving devices, and more specifically to razor cartridges having skin engaging structures that include molded filament-like protrusions.

Background Information

Many modern safety razors include a disposable razor cartridge adapted to be selectively connected to a reusable handle. The cartridge includes a housing having at least one razor blade with a sharpened cutting edge disposed therein. The housing includes a guard positioned to engage the user's skin in advance of the cutting edge of the blade, and a cap positioned aft of the cutting edge. The cartridge can be adapted for shaving in a single direction or multiple directions, most usually bi-directionally, ie in to and fro directions. Other modern safety razors include a razor cartridge permanently connected to the handle that can be disposed of as a single unit.

The present invention resides broadly in providing improved skin engaging guard and/or cap surfaces with structures that gently stretch the skin of the user to optimally erect the hair in advance of cutting edge(s). The structures can also provide a secondary function of promoting pleasant tactile sensations which tend to mask the sensations caused by contact of the blade edge(s) with the skin and more significantly with the hairs as they are severed. Many modern razor cartridges include guard structures that can have multiple rows of flexible thermoplastic elastomer (TPE) fins. These structures are disclosed in many publications including U.S. Pat. No. 5,191,712 to Crook et al. and U.S. Pat. No. 7,043,840 to Walker et al. and U.S. Patent application publication number 2005/0223568. Further structures comprising multiple generally non-fin-like TPE protrusions are disclosed in the '712 patent, above and U.S. patents including U.S. Pat. No. 6,298,557 to Gilder and U.S. Pat. No. 6,516,518 to Garraway et al. The TPE structures of the aforementioned publications that do not include straight or curved fins have protrusions that are relatively large, heights that are relatively low, aspect ratios (ie height to base width ratio) that are relatively low and spacings between adjacent protrusions that are relatively large resulting in a comparatively low protrusion density expressed as protrusions per $mm^2$ of substrate. Many of these disadvantages are caused by the known technical limits of the injection molding process employed, the known technical limits of the injection mold-making process employed and the known technical limits of the TPE materials employed especially in regard to the material completely filling the mold cavity and the molded form being ultimately removable from its mold cavity at the end of a molding cycle. The '712 patent in particular discloses an aspect ratio in the range of 2:1 to 5:1 and an inter-protrusion spacing between 0.6 mm and 1.5 mm for the TPE upstanding pillar protrusions described therein. Furthermore, typical TPE materials that can typically be employed in a guard structure are somewhat more expensive compared to commodity olefin polymers such as low density polyethylene (LDPE), high density polyethylene (HDPE) or polypropylene (PP). The environmental stability of many TPE materials, including their ability to withstand chemical attack from typical soaps and some other shaving preparations can also be generally inferior to PP and the PE derivatives noted above.

SUMMARY

The present invention has for its objective to eliminate, or at least substantially alleviate the limitations of the prior art razor cartridge skin engaging structures. In accordance, the object of the present invention is to provide a skin engaging structure for a razor cartridge that comprises a plurality of filament-like protrusions integrally formed with a substrate. The protrusions can be molded from a suitable thermoplastic material that can not necessarily be a TPE. As a result of their length and width, the protrusions can have a similar or better flexibility than known TPE protrusions under forces applied when the razor cartridge is drawn along the user's skin in normal use. The skin engaging structure can impart enhanced shaving characteristics to its razor cartridge.

Embodiments of a razor cartridge of the present invention comprise a housing having at least one razor blade having a cutting edge disposed therein. The housing has a skin engaging structure that includes a plurality of elongated protrusions extending from a substrate integrally formed therewith. The skin engaging structure comprises a molded thermoplastic polymer that can be PP, a derivative of PE or other suitable polymer, such as ABS. The protrusions can be about 1 mm or more in height and can have a width less than 0.25 mm and a spacing between adjacent protrusions less than 0.2 mm, preferably about 0.15 mm resulting in a protrusion density greater than 5 protrusions per $mm^2$. The protrusions can have a generally constant transverse cross section along their length or can be tapered or stepped. The cross section of the protrusions can be generally circular, oval or polygonal. The substrate can be integrally formed with the housing or can be permanently attached by suitable means such as by application of an adhesive or by permanently deforming a portion of the housing over a portion of the substrate, e.g. an edge extension of the substrate. The skin engaging structure can be one or both the guard and cap of the razor cartridge or a portion thereof.

Embodiments of a safety razor of the present invention can comprise a razor cartridge as previously described, connected to a handle. The connection can be permanent to provide a so-called disposable razor or the cartridge can be selectively removable by the user when appropriate to do so.

Embodiments of the invention can include one or more of the following advantages. The safety razor has excellent shaving characteristics. The skin engaging structure has manufacturing advantages.

The above features and advantages of the present invention will be more fully understood with reference to the following detailed description when taken in conjunction with the accompanying drawings.

DETAILED DESCRIPTION

Figure 1:
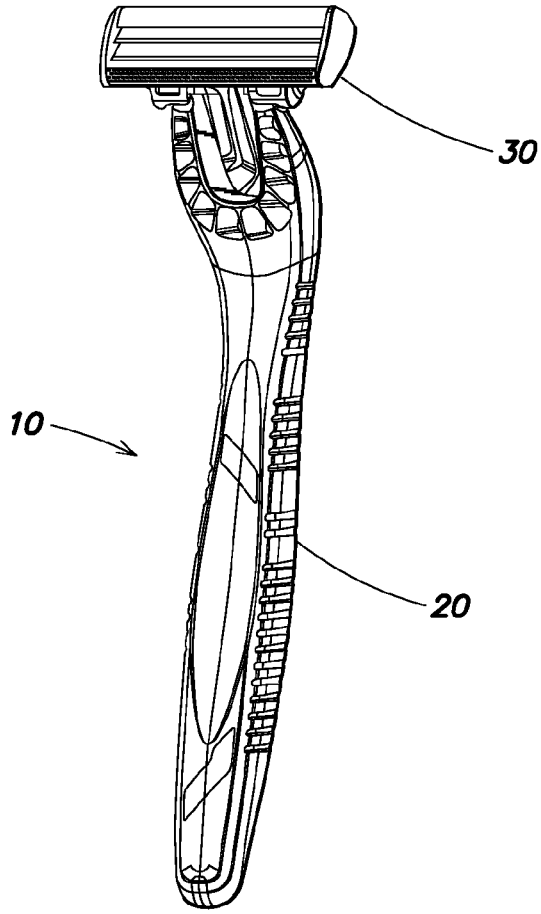
FIG. 1 is an isometric view of an embodiment of a safety razor of the present invention.
Figure 2:
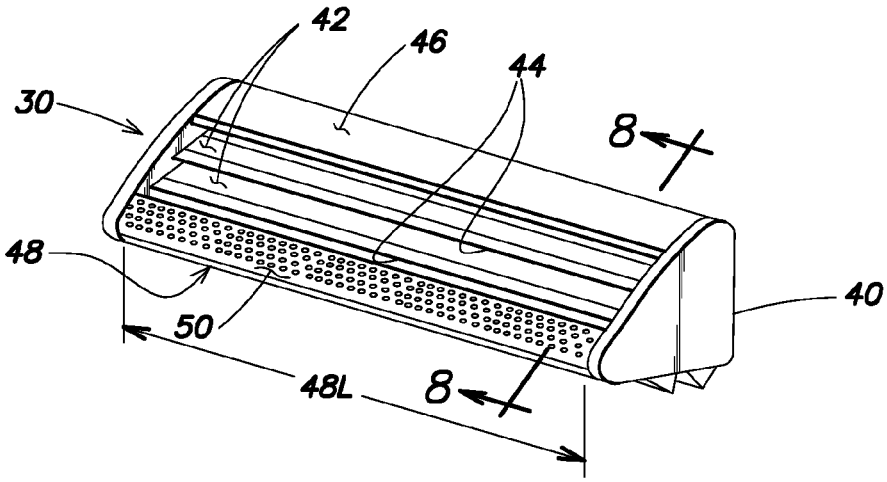
FIG. 2 is an isometric view of an embodiment of a razor cartridge of the present invention.

Referring now to the drawings and in particular FIGS. 1-2, a safety razor 10 is illustrated in FIG. 1, comprising a handle 20 having a razor cartridge 30 attached thereto. As illustrated in FIG. 2 the razor cartridge comprises a housing 40. As is well known in the art, the housing 40 can be formed from a single part or a number of individual molded parts joined together. The housing is preferably manufactured by injection molding and preferably comprises ABS or other suitable polymeric materials selected for characteristics that can include impact and chemical resistance and dimensional stability. The housing has razor blades 42, each having a cutting edge 44. In the embodiment depicted the housing has two razor blades facing in a common direction however the present invention is not limited in regard to the number or arrangement of the razor blades and can comprise three, four or more razor blades and the razor blades can face in opposing directions. The housing has a cap surface 46 disposed aft of the razor blade cutting edges relative to the direction of motion of the razor cartridge in normal use. The cap 46 can include a lubricious shaving aid material 47 (depicted in FIGS. 8A and 8B) as is well known in the art. The housing has a guard surface 48 disposed in advance of the cutting edges. One or both the guard and cap, preferably the guard, is provided with a skin engaging structure 50.

Figure 3:
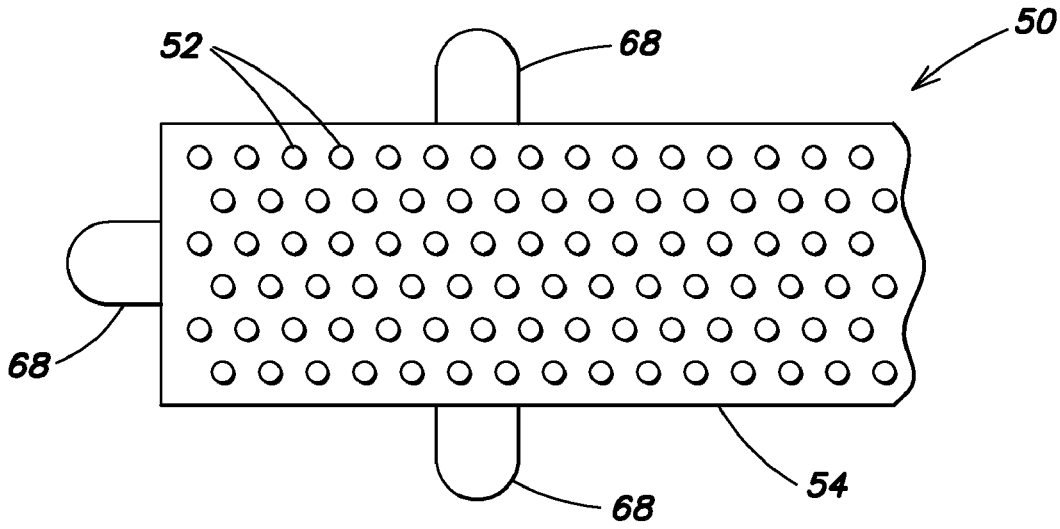
FIGS. 3-4 are respectively top and front views of a portion of an embodiment of a skin engaging structure of the present invention.
Figure 4:
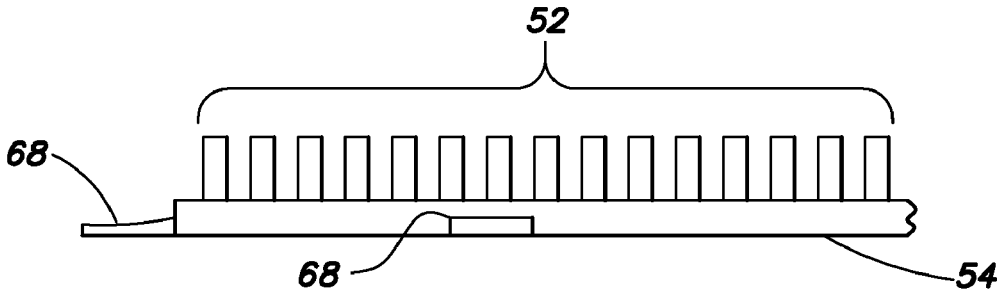

Referring additionally now to FIGS. 3-4, a portion of a skin engaging structure 50 of the housing is depicted at an enlarged scale. The skin engaging structure comprises a number of closely packed, upstanding filament-like protrusions 52, extending from and integrally formed with a substrate 54. The protrusions are preferably about 1 mm or more in height and have a width less than about 0.25 mm. In the context of the present invention width defines the largest dimension across a protrusion measured at its root and excluding any fillet radius between the protrusion and the substrate. These protrusions preferably have a spacing of less than about 0.2 mm, preferably about 0.15 mm between adjacent protrusions. The resultant protrusion density can be more than 5 protrusions per $mm^2$.

Figure 8A:
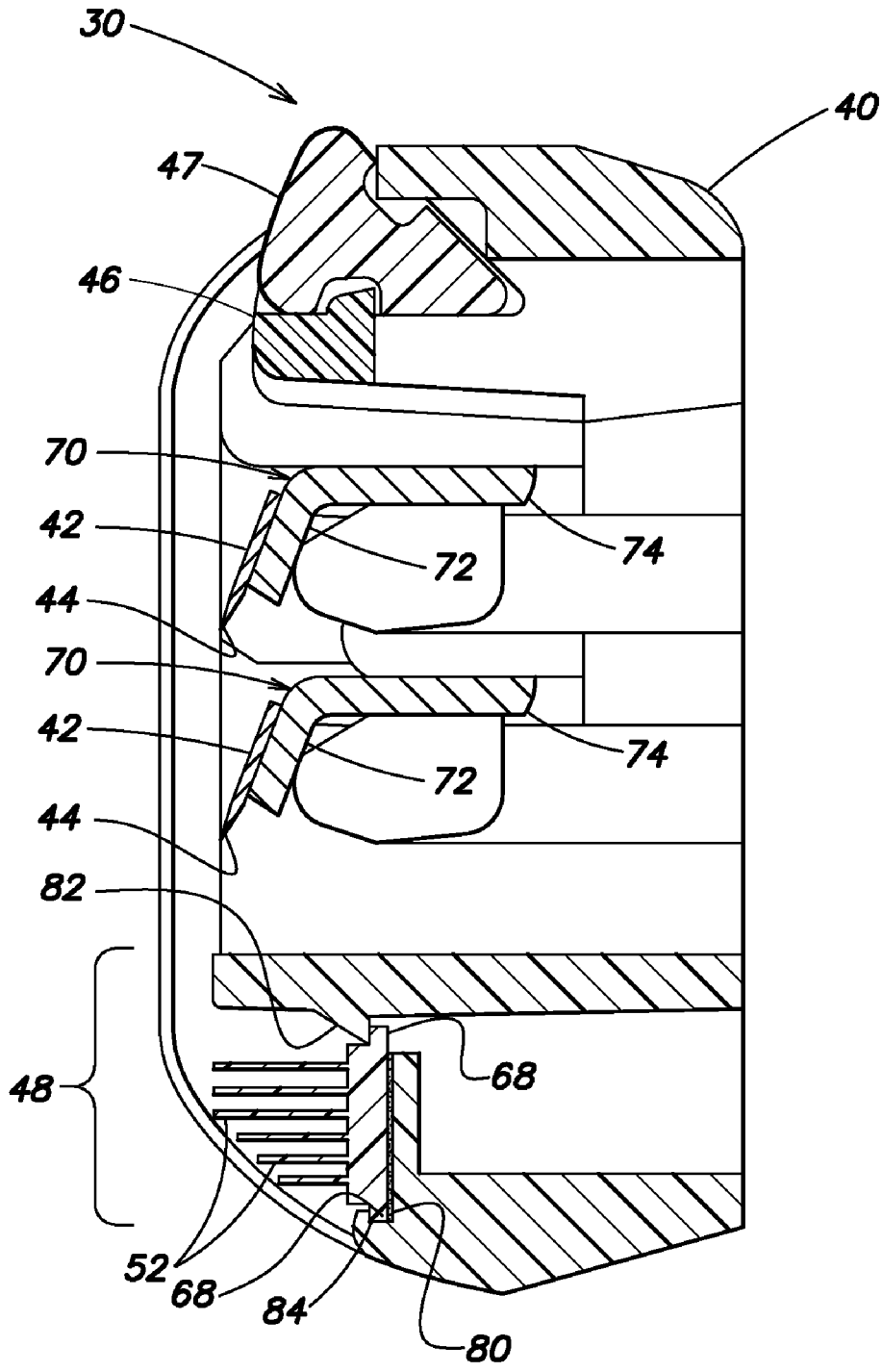
FIG. 8A is a sectional view taken on lines 8-8 of FIG. 2.

The skin engaging structure is preferably a discrete component part having its substrate portion permanently joined to the cartridge housing by suitable and well known means. Referring additionally to FIG. 8A the permanent joining can be by a layer of suitable adhesive 80. In a further embodiment, the substrate can also be provided with tabs 68 (see also FIGS. 3 and 4) integrally formed with, and extending from, the substrate. In this embodiment the permanent joining can be by one or more snap-fit features 82 of the housing engaging the tabs or portions of the substrate or by portions of the housing 84 being permanently deformed to at least partially envelop the tabs 68 or portions of the substrate in order to secure the substrate to the housing.

Figure 8B:
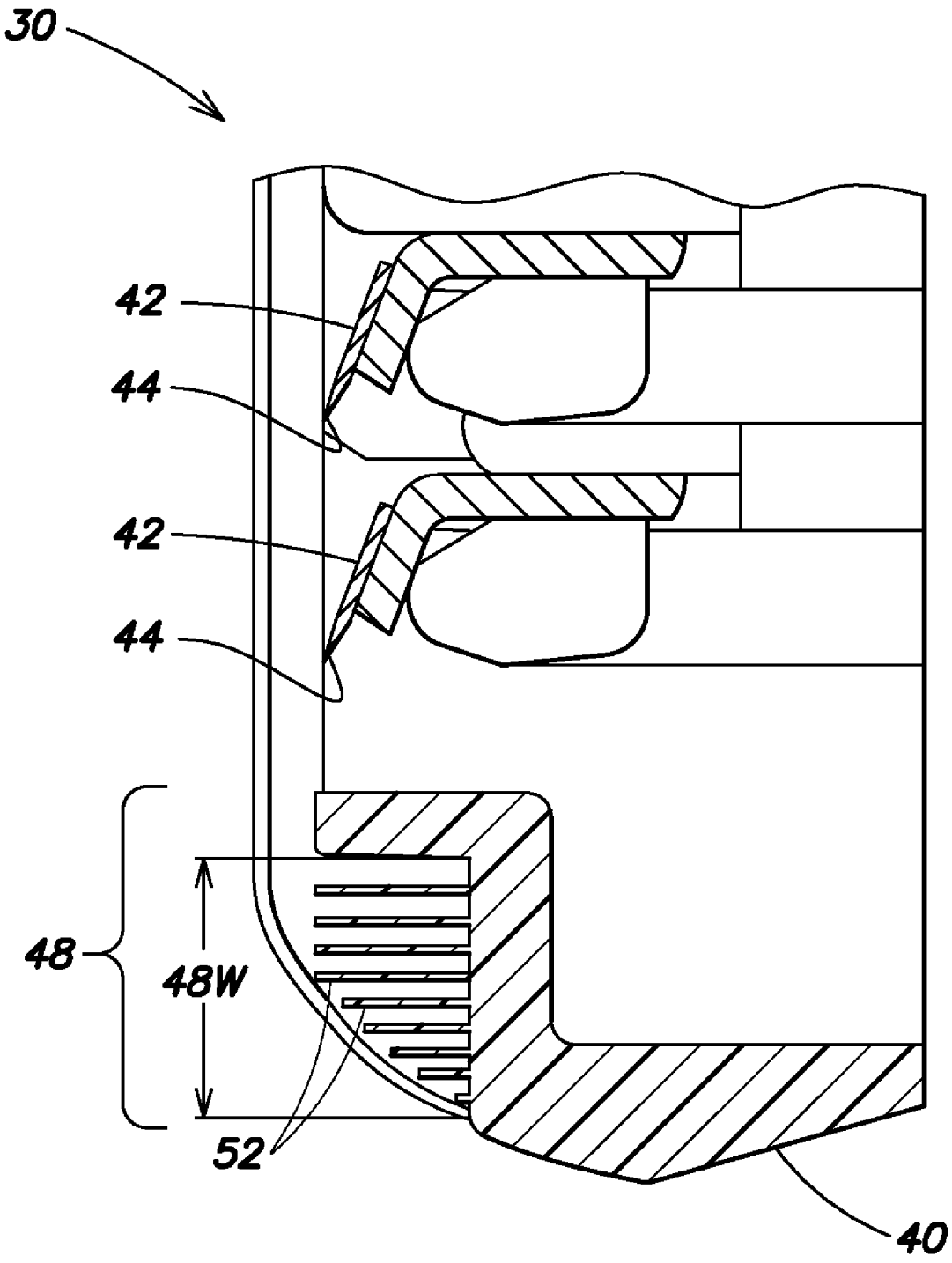
FIG. 8B is a partial sectional view similar to FIG. 8A of another embodiment of the present invention.

The skin engaging structure can also be integrally formed with the cartridge housing or one of the molded parts of the cartridge housing. FIG. 8B depicts an exemplary embodiment where the filament-like protrusions 52 are integrally formed with the cartridge housing 40. In this arrangement, as the cartridge housing is preferably molded from ABS as previously described, the filament-like protrusions will be similarly formed. The surface from which the filaments protrude has a length 48L (in FIG. 2) and a width 48W and thus a surface area can be defined. In an exemplary embodiment, a generally rectangular surface has a length 48L about 35 mm and width 48W about 2.5 mm, thus defining an area of about 87.5 $mm^2$, however the present invention is not limited in this regard and other dimensions or areal shapes may be employed. For the embodiment described, between about 230 and 650 filament-like protrusions, preferably about 436 protrusions can be usefully provided using the mold manufacturing process described as follows. The resultant protrusion density is thus between about 2.63 protrusions per $mm^2$ to about 7.43 protrusions per $mm^2$, preferably about 5.0 protrusions per $mm^2$.

As depicted in FIGS. 8A and 8B, the filament-like protrusions can diminish in height in the vicinity of the forwardmost portion of the guard 48. The filaments can also have a generally common height as depicted in FIGS. 6 and 7.

The skin engaging structure is preferably manufactured by a nano-injection molding process under typical process parameters in a suitable mold having cavities manufactured by a nano-mold making process. The skin engaging structure is preferably manufactured from a thermoplastic material having a relatively high shrinkage, more preferably an olefin polymer such as PP or a PE derivative, but materials such as TPE, polyamide (PA) and polyoxymethylene (POM) can also be employed as well as ABS. Olefin polymers in particular are selected for characteristics that include: impact and chemical resistance; relatively high shrinkage rate and low surface energy that both in turn aid removal of the part from the mold cavity at the end of the molding cycle and relatively low elastic modulus compared to so-called engineering polymers such as polyamide etc. that in turn provides preferred flexibility of the protrusions. As a result of their length and width in conjunction with the mechanical properties of the preferred material, the protrusions can have a similar or better flexibility than known TPE protrusions under forces applied when the razor cartridge is drawn along the user's skin in normal use.

Continuing to refer to FIGS. 8A and 8B, at least two (2) razor blades 42 are mounted in the housing 40. The razor blades can be generally planar or can include a bent portion as is well known in the art. Generally planar razor blades having sharpened cutting edges 44 are mounted on bent supports 70. The supports have a support portion 72 and a base portion 74. The base portions 74 of the supports 70 are mounted in respective slots in the housing. In further embodiments alternative means for mounting the razor blades within the housing can be employed. Alternative means for mounting blades within the housing can include: using adhesive to secure the blades as is disclosed in U.S. Pat. No. 5,481,802 to Lembke; insert molding the blades within the housing as is disclosed in U.S. Pat. No. 5,141,694 to Butlin et al; mounting the blades on an intermediate blade carrier component that is then mounted within the housing as is disclosed in U.S. patent application Ser. No. 10/765,549 or mounting the blades on posts that project from the cap as is disclosed in U.S. Pat. No. 3,724,070 to Dorion, or that project from the guard. The means for mounting the blades within the housing is well known to one of skill in the art and the present invention is not limited in this regard.

Figure 5:
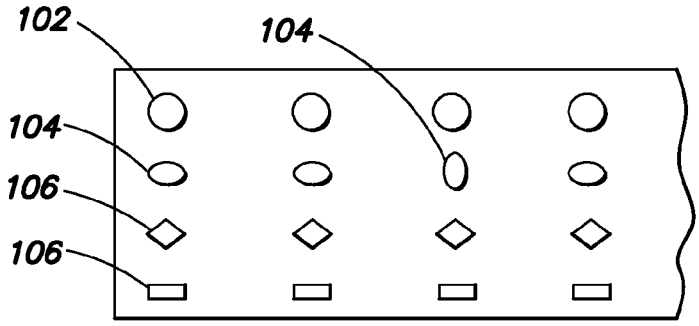
FIG. 5-7 are respectively top, front and side views of portions of further embodiments of the skin engaging structure of the present invention.
Figure 6:
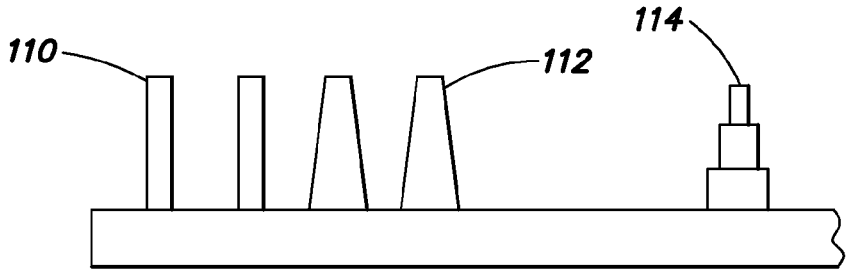
Figure 7:
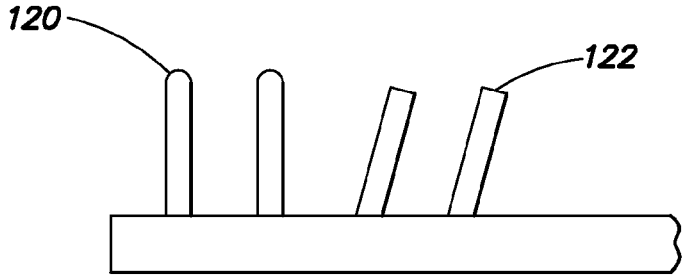

Referring additionally now to FIGS. 5-7, portions of further embodiments of the skin engaging structure are depicted at an enlarged scale. For convenience of illustration, multiple protrusion types are shown in combination however one of skill in the art will understand an entire skin engaging structure can comprise all one type of protrusion or multiple types in combination. FIG. 5 shows protrusions that can be circular, 102, oval, 104 and polygonal 106 and that can be arranged in a plurality of parallel rows as depicted in FIGS. 3 and 5. The protrusions can also be randomly distributed as depicted in FIG. 2. FIG. 6 shows protrusions that can have substantially parallel sides 110 but are preferably tapered (i.e. drafted) 112, most preferably at about 3° per side to assist removal of the protrusions of the skin engaging structure from their respective mold cavities. The protrusions can also be stepped 114. FIG. 7 shows protrusions that can extent perpendicularly from the substrate 120 or can extend at an angle to the substrate 122.

Figure 9A:
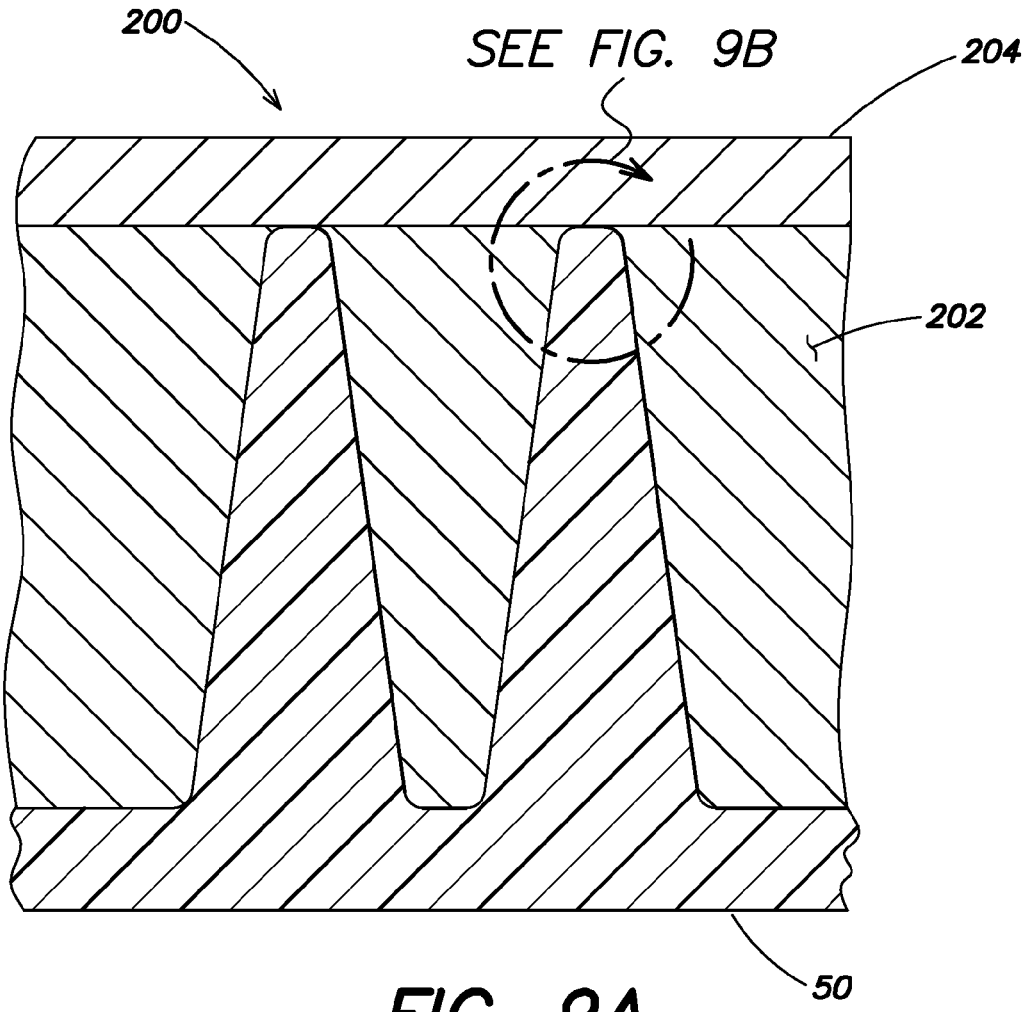
FIG. 9A is a sectional view of a portion of the skin engaging structure of FIGS. 5-7 shown with its respective mold cavity.
Figure 9B:
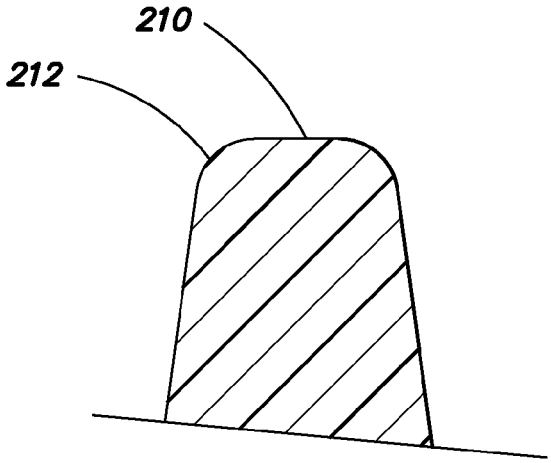
FIG. 9B is an enlarged view of the tip portion of the skin engaging structure of FIG. 9A.

Referring additionally now to FIGS. 9A and 9B, a sectional view of a portion of a preferred skin engaging structure 50 shown with a portion of its respective mold cavity 200 for forming the protrusions and a portion thereof is shown at an enlarged scale. To assist with venting, i.e. the removal of entrapped air from the mold cavity during the injection phase of the molding cycle the mold cavity preferably comprises at least two plates 202, 204 including a sieve plate 202 having through holes. The through holes are preferably manufactured by drilling a start hole having a diameter in the range about 0.05 mm to 0.1 mm in plate 202, followed by a high speed milling operation to provide the desired form. The desired form can also be provided by one or more erosion operations. The tip portions of the protrusions formed in such a mold cavity can include a flat portion 210 and a chamfered or rounded portion 212. The mold cavity can also be manufactured by providing suitable blind holes in a single mold plate.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. For instance, features disclosed in connection with any one embodiment can be used alone or in combination with each feature of the respective other embodiments. Those skilled in the art will further recognize that variations and modifications can be made within the scope of the invention.

What we claim is:

1. A skin engaging structure for a razor cartridge comprising:

a plurality of elongated filament-like protrusions comprising a non-elastomeric thermoplastic polymer, the protrusions extending from a substrate integrally formed with the protrusions;

wherein the protrusions have a width less than 0.25 mm defined at their respective roots and a spacing between adjacent protrusions less than 0.2 mm.

2. The skin engaging structure of claim 1, wherein the spacing between adjacent protrusions is about 0.15 mm.

3. The skin engaging structure of claim 1, wherein the thermoplastic polymer is a polyolefin.

4. The skin engaging structure of claim 1, wherein a transverse cross-section of any one protrusion is one of circular, oval and polygonal.

5. The skin engaging structure of claim 1, wherein any one protrusion has substantially parallel sides.

6. The skin engaging structure of claim 1, wherein any one protrusion is tapered.

7. The skin engaging structure of claim 1, wherein any one protrusion has stepped sides.

8. The skin engaging structure of claim 1, wherein protrusions are arranged in a plurality of parallel rows.

9. The skin engaging structure of claim 1, wherein the protrusions are randomly distributed.

10. The skin engaging structure of claim 1, wherein the protrusions have a density greater than 5 protrusions per $mm^2$.

* * * * *